US009121366B2

(12) United States Patent
Potts

(10) Patent No.: US 9,121,366 B2
(45) Date of Patent: Sep. 1, 2015

(54) INDUCED FLOW INTAKE FOR AN INTERNAL COMBUSTION ENGINE

(71) Applicant: Graeme Potts, Fonthill (CA)

(72) Inventor: Graeme Potts, Fonthill (CA)

( * ) Notice: Subject to any disclaimer, the term of this patent is extended or adjusted under 35 U.S.C. 154(b) by 0 days.

(21) Appl. No.: 14/290,323

(22) Filed: May 29, 2014

(65) Prior Publication Data

US 2014/0366831 A1 Dec. 18, 2014

Related U.S. Application Data

(60) Provisional application No. 61/836,192, filed on Jun. 18, 2013.

(51) Int. Cl.
*F02M 35/10* (2006.01)
*F02F 1/42* (2006.01)

(52) U.S. Cl.
CPC ..... *F02F 1/4235* (2013.01); *F02M 35/10039* (2013.01); *F02M 35/10072* (2013.01)

(58) Field of Classification Search
CPC ..... F02M 35/10039; F02M 35/10072
USPC ..... 123/184.21
See application file for complete search history.

(56) References Cited

U.S. PATENT DOCUMENTS

| | | | | | |
|---|---|---|---|---|---|
| 906,393 | A | * | 12/1908 | Dock | 123/184.58 |
| 1,938,164 | A | * | 12/1933 | Zurmuhle | 123/184.39 |
| 4,625,686 | A | * | 12/1986 | Kubis | 123/184.43 |
| 4,766,853 | A | * | 8/1988 | Iwanami | 123/184.49 |
| 4,829,941 | A | * | 5/1989 | Hitomi et al. | 123/184.31 |
| 4,889,082 | A | * | 12/1989 | Hitomi et al. | 123/184.31 |
| 5,474,102 | A | * | 12/1995 | Lopez | 137/271 |
| 5,632,239 | A | * | 5/1997 | Patyi et al. | 123/184.36 |
| 5,704,326 | A | * | 1/1998 | Minegishi et al. | 123/184.53 |
| 6,213,074 | B1 | * | 4/2001 | Freese | 123/90.38 |

* cited by examiner

*Primary Examiner* — Marguerite McMahon
*Assistant Examiner* — James Kim

(57) ABSTRACT

The present concept is an intake system for a multi cylinder internal combustion engine head which includes a multi-cylinder longitudinally oriented inline cylinder head at least one intake valve corresponding to each cylinder, and an intake runner extending longitudinally within the head, the intake runner interconnecting and communicating intake gases to each intake valve. The intake runner terminating at each end at an intake inlet adapted to connect to an intake manifold.

10 Claims, 6 Drawing Sheets

FIG. 1

INDUCED FLOW INTAKE FOR AN INTERNAL COMBUSTION ENGINE

This application claims priority from previously filed U.S. provisional application No. 61/836,192 filed Jun. 18, 2013, by Graeme Potts under the title; Induced Flow Intake for an Internal Combustion Engine.

FIELD OF THE INVENTION

The present invention relates to internal combustion engines and more particularly relates to intake manifolds and intake structures for internal combustion engines and is particularly advantageous to multi cylinder engines.

BACKGROUND OF THE INVENTION

Presently internal combustion engines particularly 4 cycle engines typically utilize separate intake and exhaust valves and separate intake and exhaust runners for each valve. In other words each intake valve or set of intake valves is supplied by an individual intake runner via the intake manifold. Similarly each exhaust valve and/or each set of exhaust valves typically is connected to a separate and individual exhaust runner which leads into the exhaust manifold.

With improvements in the ability to very specifically mix quantities of air and fuel together either through fuel injection techniques and/or direct injection into each individual cylinder it is now possible to utilize a single integral intake runner in an internal combustion engine head.

SUMMARY OF THE INVENTION

The present concept an intake system for a multi cylinder internal combustion engine head comprising:

a) a multi-cylinder longitudinally oriented inline cylinder head;

b) at least one intake valve corresponding to each cylinder;

c) an intake runner extending longitudinally within the head, the intake runner interconnecting and communicating intake gases to each intake valve;

d) the intake runner terminating at each end at an intake inlet adapted to connect to an intake manifold.

Preferably wherein inlet gases are received at two intake inlets, one intake inlet located at one distal end of the inlet runner and another located at the other distal end of the inlet runner.

Preferably wherein the inlet gases enter the intake inlet in opposing directions such that they approach each other within intake runner.

Preferably wherein the intake gases entering at each intake inlet intermix at an intake valve that is open thereby admitting intake gases intermixed from both intake inlets.

Preferably wherein the intake runner is a straight linear runner having a circular cross section with two intake inlets located at each distal end of the intake runner.

Preferably wherein the intake runner in communication with each intake valve such that intake flow within the intake runner to any intake valve induces flow to other intake valves.

The present concept a cylinder head for a multi cylinder inline internal combustion engine comprising:

a) a longitudinally oriented cylinder head for housing at least two intake valves;

b) the at least two intake valves receiving inlet gases from a longitudinally oriented intake runner spanning the entire longitudinal distance between the intake valves;

c) the intake runner in simultaneous communication with the at least two intake valves for communicating inlet gases to the at least two intake valves;

d) the intake runner includes two intake inlets one at each distal end of the intake runner.

Preferably wherein the intake runner is a tubular straight linear runner having a circular cross section with openings to each of the intake valves.

Preferably wherein the inlet gases entering at opposing ends of the intake runner flow in opposing directions towards each other meeting and intermixing at an intake valve that is open.

Preferably wherein the intake air flow induces flow from one open intake valve to the next open intake valve.

BRIEF DESCRIPTION OF THE DRAWINGS

The present invention will now be described by way of example only with reference to the following drawings in which.

BEST MODE FOR CARRYING OUT THE INVENTION

Figure 1:
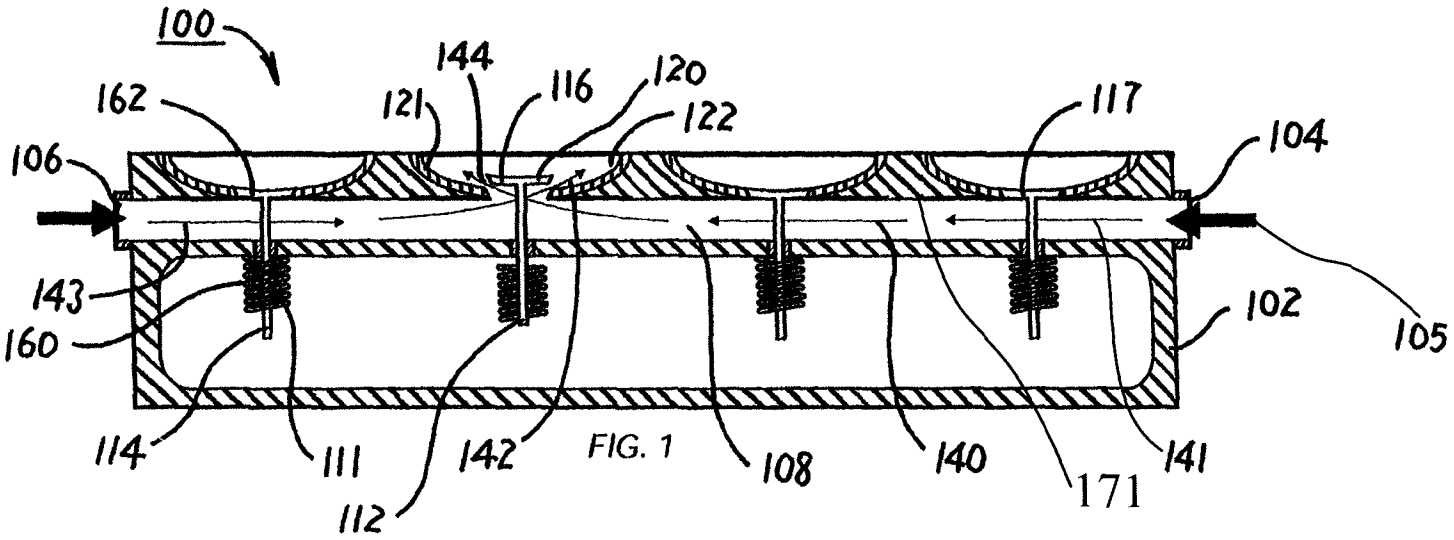
FIG. 1 is a schematic cross-sectional view of an inline four cylinder internal combustion head showing one valve in the open position.

Referring now to FIG. 1 the present concept an intake for internal combustion engine shown generally as 100 includes a head 102 which in this case is drawn and depicted for an inline four cylinder conventional internal combustion engine.

A person skilled in the art will note that this concept could also work for a two or more inline cylinder engine of conventional internal combustion design. It may also apply to gasoline, diesel, naturally aspirated or forced induction engine.

Head 102 further includes a number of valves 116 for example as well as intake valve 111 which include valve springs 160 and are in the normally closed position 162.

Figure 2:
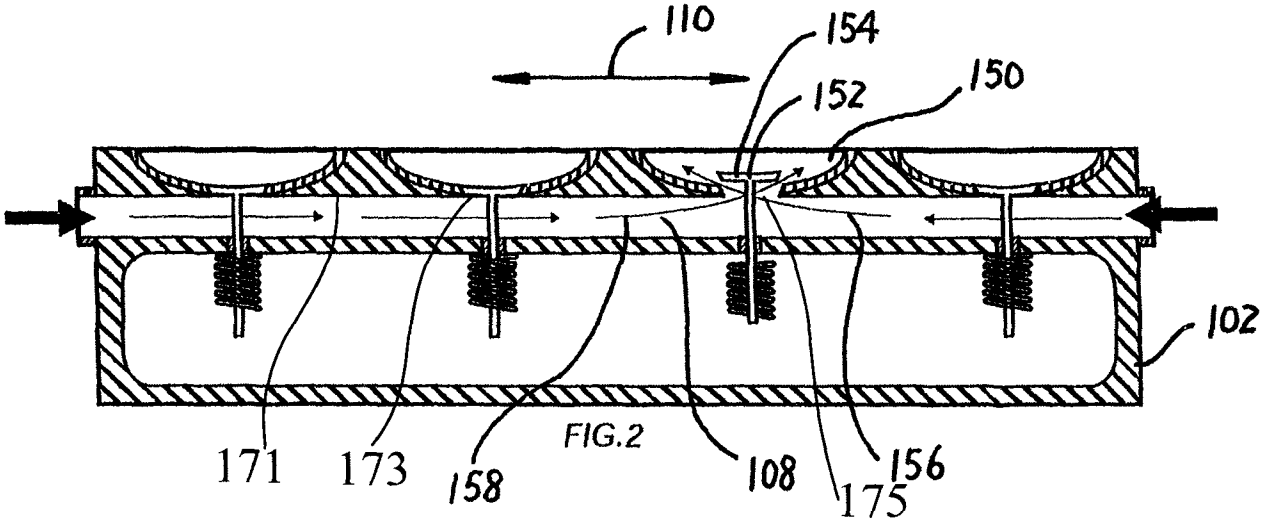
FIG. 2 is a schematic cross-sectional view of an inline four cylinder internal combustion head showing one valve in the open position.

The major components of the intake for internal combustion engine 100 includes a head 102 having two intake inlets 104 and 106 which communicate air and/or air and gas mixtures through an intake runner 108 which is oriented along the longitudinal direction 110, as shown in FIG. 2.

Head 102 further includes valves 112, valve stems 114 and valve heads 117.

In FIG. 1, one of the valves is shown in the open position 120 partially projecting into the combustion chamber 122 of the, in this case second cylinder 121 from the left. Back face 173 of the valve head 117 of intake valve 111 forms part of the inner surface 171 of intake runner 108.

Piston movement in second cylinder 121 causes combustion inlet gases 105 to be drawn into intake inlets 104 and 106 and is drawn in towards the cylinder which has an intake valve in the open position 120 which in this case is at cylinder number 2 namely 121 wherein the arrows shown intake air flows 140. Inlet gas flow 141 enters intake inlet 104 in opposing direction to inlet gas flow 143 at intake inlet 106 such that inlet gas flow 141 and inlet gas flow 143 approach one another in intake runner 108.

In this application the terms intake air and intake gases are used interchangeably and mean the gases introduced into the cylinder via the intake runner. In practice intake air or intake gases may be non fuel bearing gases such as pure air in the case where fuel is injected directly into the cylinder. Intake air or intake gases may be a mixture of fuel and air in for example carburetted engines. Intake air or intake gases may also include other gases such as nitrous oxide, pure oxygen, and any number of fuels.

As air enters into combustion chamber 122 at open position 120 of valve 112 intake air flow is shown as intake air flow 142 and intake air flow 144 around the face of valve head 112. In open position 120 valve head 117 uncovers intake port 175 into the cylinder and creates on opening or aperture in inner surface 171 of intake runner 108.

Referring now to FIG. 2 one will see that in this case third cylinder or cylinder number 3 shown as 150 with valve 152 in the open position 154 showing the flow of intake airflow 156 and intake airflow 158 around valve 152.

Intake runner 108 extends along the longitudinal direction 110 of head 102. Inlet gases 105 enter at the distal ends of intake runner 108 in opposing directions towards each other. Once intake air enters into intake inlet 104 and/or intake inlet 106 it moves in a longitudinal direction toward one or more of the cylinders and each of the intake valves. Preferably intake runner 108 is a straight linear runner having a circular cross sectional geometry however it may be a curved or irregular shaped runner having any number of cross sectional geometries including oval, square, triangular etc.

As one of the valves for example valve 116 in FIG. 1 opens to the open position 120 inlet air flows around the valve head as shown as intake airflow 142 and intake air 144.

If the next cylinder in line to receive air is cylinder number three shown as 150 in FIG. 2 then the inlet intake airflow 140 still continues from the outer intake inlets 104 and 106 toward the cylinder which has the open valve which in this case is valve 152 which is in open position 154.

In this way the inlet gases 105 received at inlets 104 and 106 tends to move continuously in the same direction namely from the inlets 104 and 106 longitudinally inwardly towards one or more of the cylinders, the intake action of each intake event induces flow toward the next cylinder in sequence.

Figure 3:
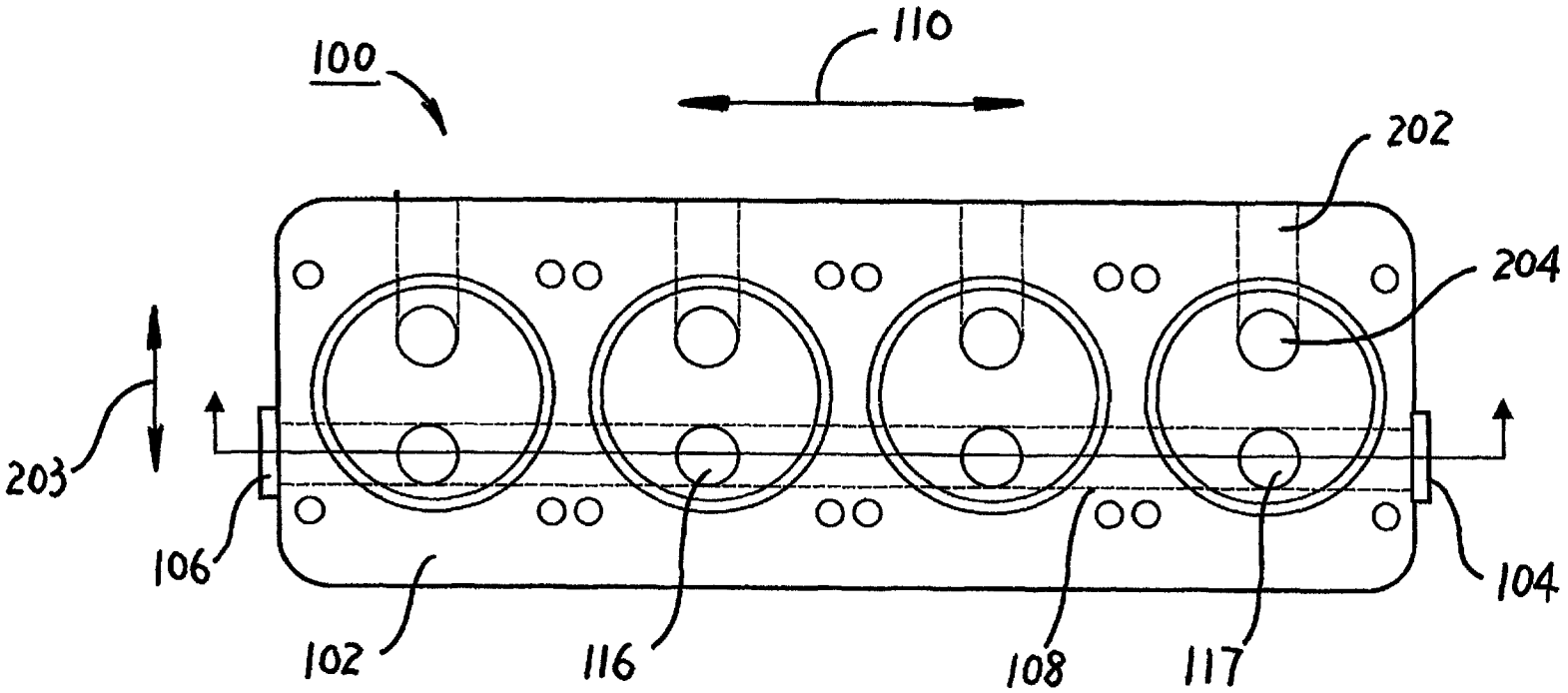
FIG. 3 is a bottom plan view of the internal combustion engine head showing in dashed lines the exhaust runners and the intake runner.

Shown in schematic fashion in FIG. 3 is a plan view of the bottom side of the cylinder head 102 showing the conventional exhaust runners 202 which typically are in a transverse direction 203 relative to a longitudinal direction 110 of the cylinder head.

In conventional internal combustion engines the intake runners would also be extending in the transverse direction 203 however the present concept includes a longitudinally oriented intake runner 108 as shown in FIG. 3.

Figure 4:
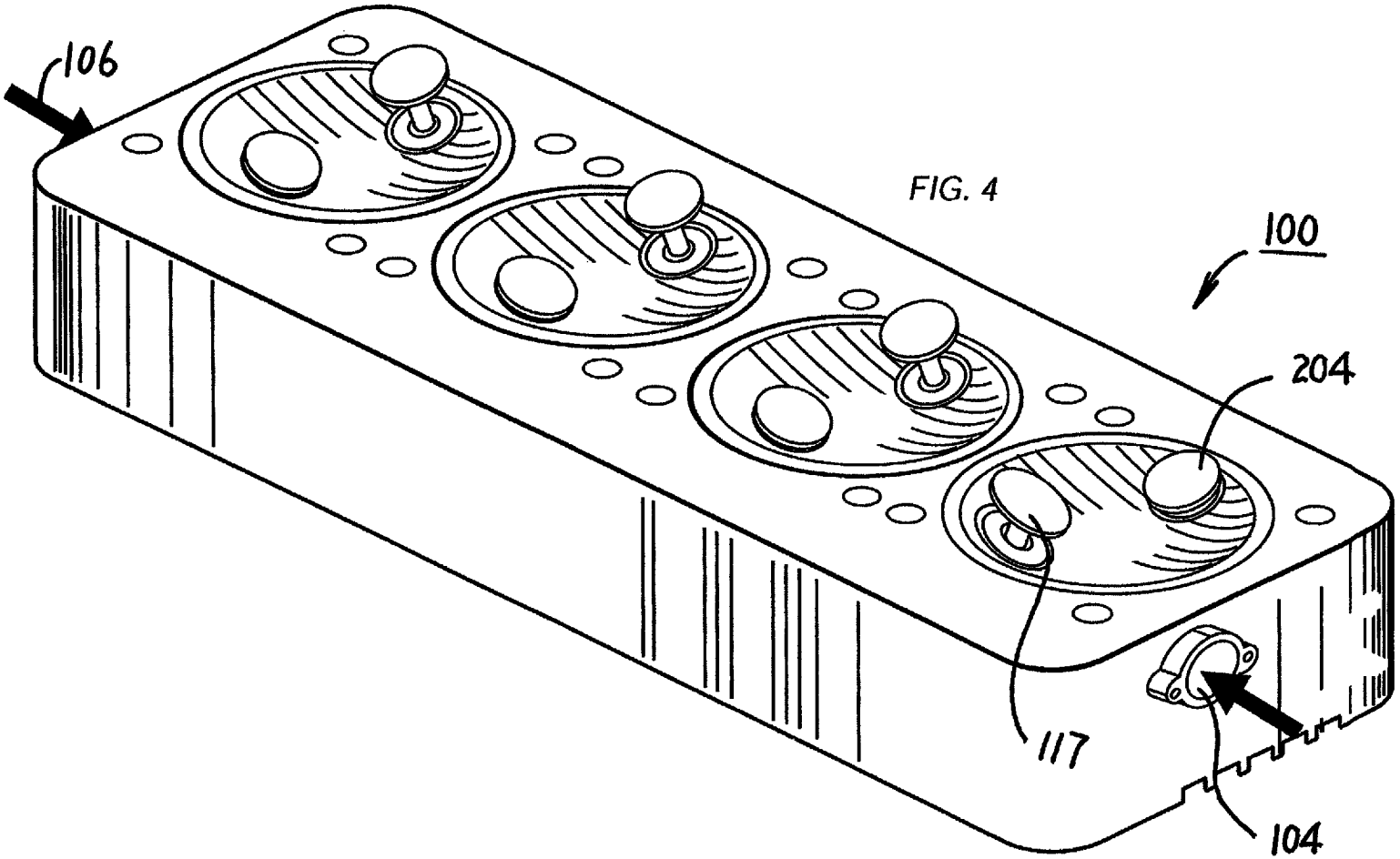
FIG. 4 is a schematic perspective view of the bottom of the internal combustion engine head showing portions of the combustion chambers and the valves.

FIG. 4 shows in schematic fashion a perspective view of the bottom of the cylinder head wherein the reader will note that the cylinder head combustion chamber and valve orientations are typical of a current state of the art internal combustion engine head 102 with the modification that the intake runner 102 is now formed as a longitudinal passageway along the longitudinal direction of the head, thereby joining all the intake valves in communication of intake air.

Figure 5:
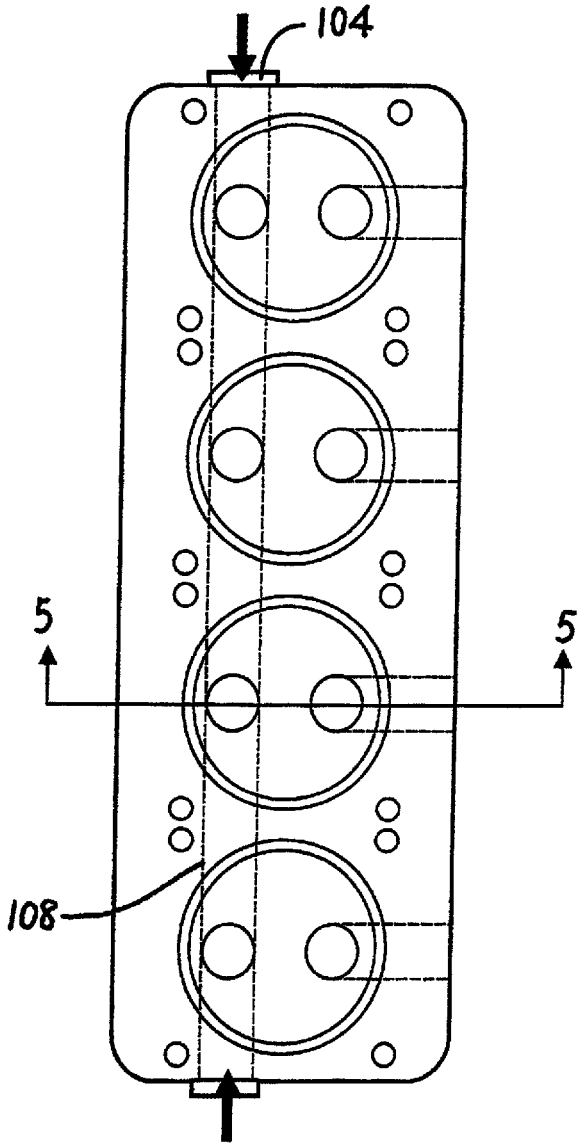
FIG. 5 is a bottom plan view of the bottom portion of the internal combustion engine head showing in dashed lines the exhaust runners and the intake runner.
Figure 6:
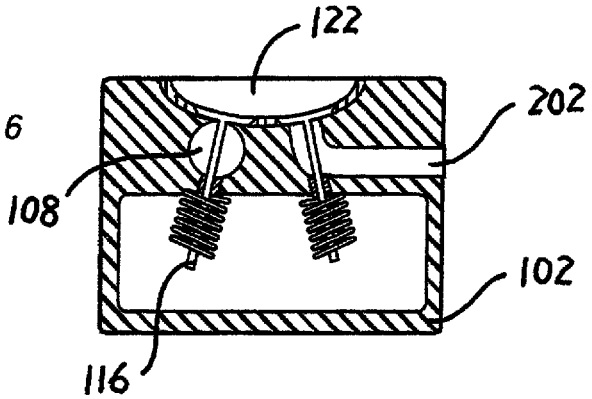
FIG. 6 is a cross sectional view taken along lines 5-5 of FIG. 5.

Referring now to FIG. 6 which is a cross sectional view along lines 5-5 of FIG. 5 one will note that the conventional exhaust runner 202 is shown servicing the exhaust valve in head 102. Alternatively, the intake valve 106 is being serviced by intake air via an intake runner 108 which essentially is a passageway in the longitudinal direction running through the entire length of head 102.

Figure 7:
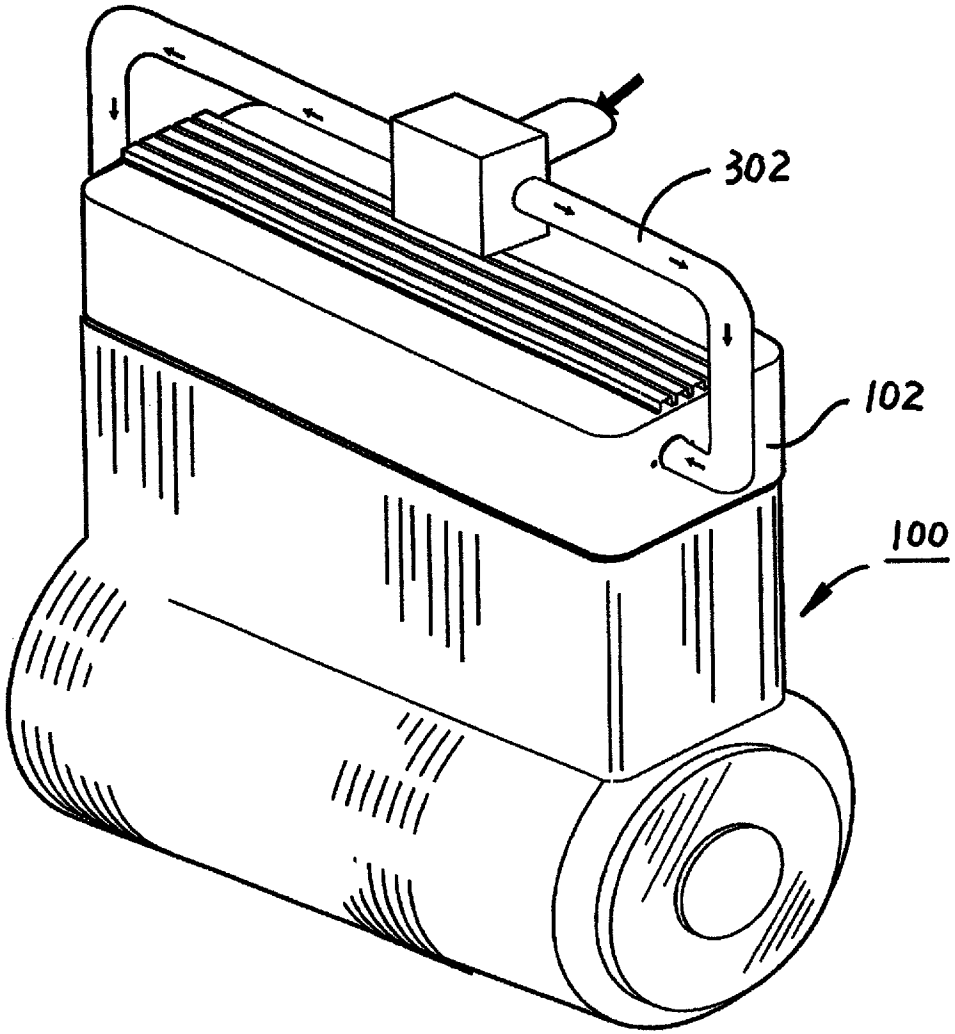
FIG. 7 is a schematic front perspective view of internal combustion engine shown with the intake manifold.

FIG. 7 is a schematic perspective view of an internal combustion engine with the presently designed head 102 using the presently designed intake for internal combustion engine 100 showing an intake manifold 302 which for example could be used with head 102.

Figure 8:
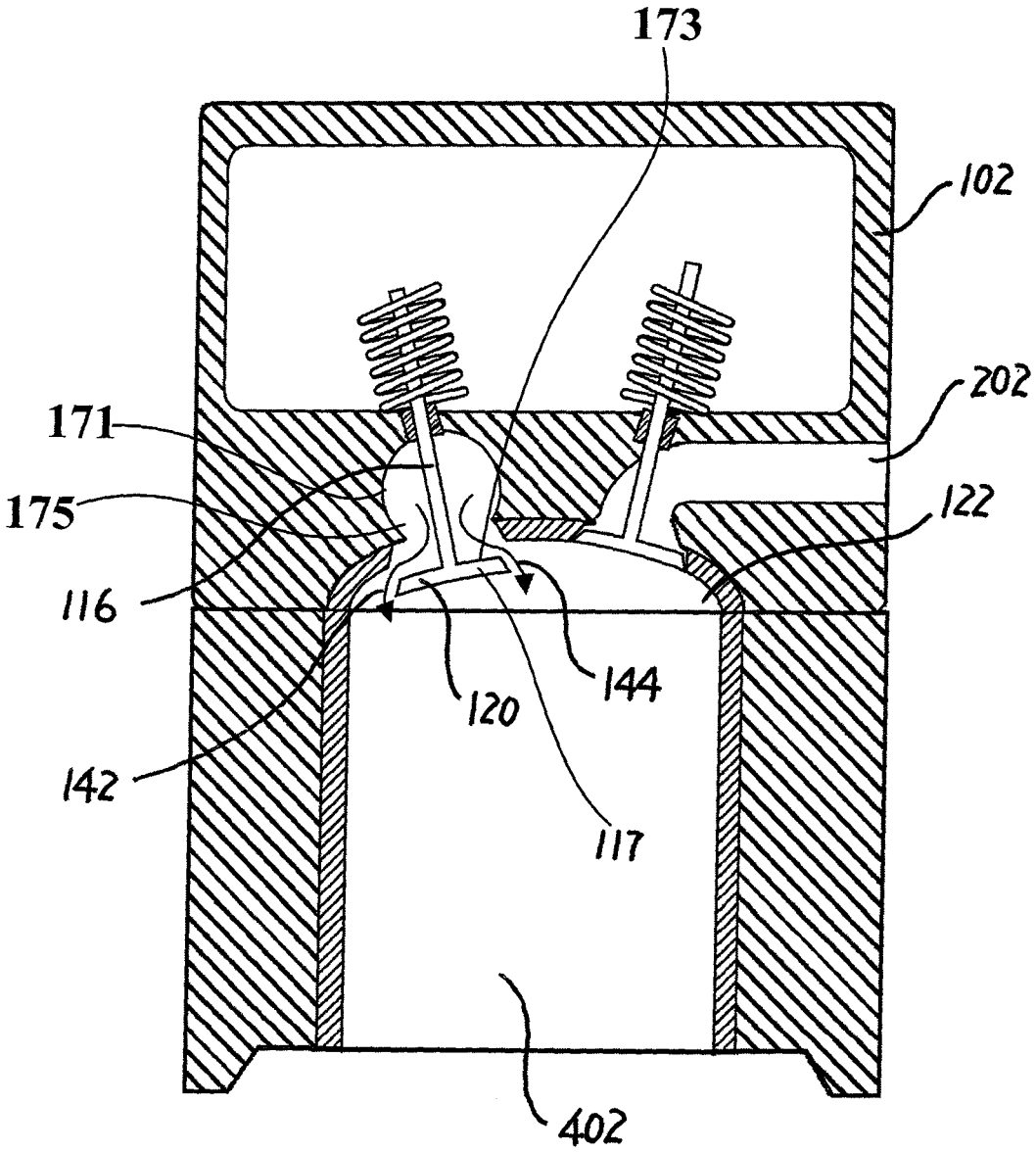
FIG. 8 is a schematic cross-sectional view of a single cylinder part of an internal combustion engine head showing an intake valve in the open position and an exhaust valve with the runner.

FIG. 8 shows a cross sectional view of valve 116 in an open position 120 with intake air flow 142 and 144 around the valve head. This is to illustrate that intake air will flow around the circumference of the intake valve face.

Cylinder 402 is also shown together with combustion chamber 122.

In Use

In use the presently designed intake for internal combustion engine 100 allow for longitudinal intake flow through the head 102. As each successive intake valve 116 is opened the flow direction of the inlet air continues from the intake inlets 104 and 106 towards one or more of the inlet valves. Flow is thus induced by each successive intake valve action, which is not a feature of conventional cylinder head design.

In this matter the inlet air intake airflow is less interrupted and smoother in that as one inlet air valve is closing another inlet air valve is opening thereby reinforcing the flow direction of the intake airflow 140, in fact inducing air flow to each intake valve.

In a conventional combustion engine each individual intake valve would be fed by a separate intake runner similar to the exhaust runners 202 shown in FIG. 3. Normally these runners extend in the transverse direction to the cylinder head 102.

In the prior art conventional arrangement once the valve closes the air movement is completely stopped and the air does not begin to move again until the valve opens. In fact a reverse mass air flow effect is caused in the opposite direction of air flow. Therefore the airflow is constantly starting and stopping and partially reversing. This phenomenon of starting and stopping of inlet air is much reduced using a longitudinally oriented intake runner 108 as shown in FIGS. 1 thorough 8 due to its physical orientation and due to the reinforcing effect of the flow from one cylinder to the next as one intake air valve opens after another.

The interconnection of the intake runner 108 to all of the intake valves reinforces the intake airflow 140 to continually move from the intake inlets 104 and 106 inwardly towards the open intake air valve. The intake air may in fact be just air or a premixed combination of air and fuel. The intake runner 108 is in communication with each intake valves such that intake air flow 140 within intake runner 108 to any intake valve induces flow to all the other intake valves. For example inlet gases flow 141 moving towards second cylinder 121 is also moving toward third cylinder 150. Inlet gas flow 143 moving toward second cylinder 121 is also moving in the correct direction toward third cylinder 150. This effect is referred to inducing flow of inlet gases.

It should be apparent to persons skilled in the arts that various modifications and adaptation of this structure described above are possible without departure from the spirit of the invention the scope of which defined in the appended claim.

I claim:

1. An intake system, for an internal combustion engine head communicating inlet gases to at least two cylinders, the intake system comprising:

a) a longitudinally oriented inline cylinder head communicating inlet gases to at least two cylinders, the cylinder head includes two intake inlets one at each longitudinal end of the cylinder head;

b) at least one intake valve in the cylinder head corresponding to each cylinder;

c) an single contiguous intake runner extending longitudinally within the cylinder head, the intake runner interconnecting and communicating intake gases to each intake valve and directly into the cylinder when the intake valve is in an open position;

d) the intake runner terminating, at each longitudinal end of the cylinder head at the intake inlets adapted to connect to an intake manifold;

e) wherein in an intake valve closed position a back face of the intake valve forms part of an inner surface of the single intake runner and in an open position the intake valve opens an intake port directly into the single inlet runner such that intake air flows across the back face of the intake valve and into the cylinder.

2. The intake runner claimed in claim 1 wherein inlet gases are received at two intake inlets, one intake inlet located at one distal end of the inlet runner and another located at the other distal end of the inlet runner.

3. The intake runner claimed in claim 1 wherein the inlet gases enter the intake inlet in opposing directions such that they approach each other within intake runner.

4. The intake runner claimed in claim 1 wherein the intake gases entering at each intake inlet intermix at an intake valve that is open thereby admitting intake gases intermixed from both intake inlets.

5. The intake runner claimed in claim 1 wherein the intake runner is a straight linear runner having a circular cross section with two intake inlets, one intake inlet located at each distal end of the intake runner.

6. The intake runner claimed in claim 5 wherein the intake runner in communication with each intake valve such that intake flow within the intake runner to any intake valve induces flow to other intake valves.

7. A cylinder head for an inline internal combustion engine, comprising:

a) a longitudinally oriented cylinder head housing at least two intake valves for communicating inlet gas to at least two cylinders;

b) the at least two intake valves receiving inlet gases from a single contiguous longitudinally oriented intake runner spanning the entire longitudinal distance between the intake valves, wherein in an intake valve closed position the back face of the intake valve forms part of an inner surface of the single intake runner and in an open position the intake valve opens an intake port directly into the single intake runner such that intake air flows across the back face of the intake valve and into the cylinder;

c) the intake runner in simultaneous communication with the at least two intake valves, the intake runner for communicating inlet gases to the at least two intake valves;

d) the intake runner further includes two intake inlets one at each distal end of the intake runner.

8. The cylinder head claimed in claim 7 wherein the intake runner is a tubular straight linear runner having a circular cross section with intake port-openings corresponding to each of the intake valves.

9. The cylinder head claimed in claim 8 wherein the inlet gases entering at opposing ends of the intake runner, flow in opposing directions towards each other meeting and intermixing at an intake valve that is open.

10. The cylinder head claimed in claim 9 wherein the intake air flow induces flow from one open intake valve to the next open intake valve.

* * * * *